United States Patent [19]

Saveth

[11] 4,002,287

[45] Jan. 11, 1977

[54] RELATIVELY FLAT BLANK FOR A CONTAINER AND THE CONTAINER MADE THEREFROM

[76] Inventor: Saul Saveth, 132-29 33rd Ave., Flushing, N.Y. 11354

[22] Filed: Dec. 5, 1975

[21] Appl. No.: 638,058

Related U.S. Application Data

[63] Continuation-in-part of Ser. No. 526,371, Nov. 22, 1974, Pat. No. 3,924,798.

[52] U.S. Cl. ..... 229/23 AB; 220/62; 220/DIG. 25; 229/33; 229/41 B

[51] Int. Cl.[2] ..... B65D 11/10; B65D 11/22

[58] Field of Search ..... 220/4 E, DIG. 15, DIG. 25, 220/62; 229/23 AB, 30, 33, 41 B

[56] References Cited

UNITED STATES PATENTS

| | | | |
|---|---|---|---|
| 459,697 | 9/1891 | Atkinson | 220/62 |
| 1,075,369 | 10/1913 | Millice | 220/62 X |
| 2,808,976 | 10/1957 | Chaplin | 229/30 X |
| 3,330,437 | 7/1967 | Bellamy | 220/62 |
| 3,424,365 | 1/1969 | Venturi | 229/30 |
| 3,484,015 | 12/1969 | Rowan | 220/4 E |
| 3,497,127 | 2/1970 | Box | 229/41 B X |
| 3,675,808 | 7/1972 | Brink | 229/30 X |
| 3,924,798 | 12/1975 | Saueth | 229/41 B X |

*Primary Examiner*—Stephen P. Garbe
*Attorney, Agent, or Firm*—Roberts & Cohen

[57] ABSTRACT

A container is fabricated from first and second sections, each of which includes a central sector and wing sectors connected on opposite sides thereof. Each of the sections is foldable into a U-shape and the two sections are interengageable with each other to form a parallelepiped structure enclosing a chamber. One or more of the wing sectors has hooks formed therein for interengagement with hooks on the center sector of the other of the sections for locking the sections together. The first and second sections are preferably identical separate parts which are interengageable.

13 Claims, 12 Drawing Figures

FIG. 1
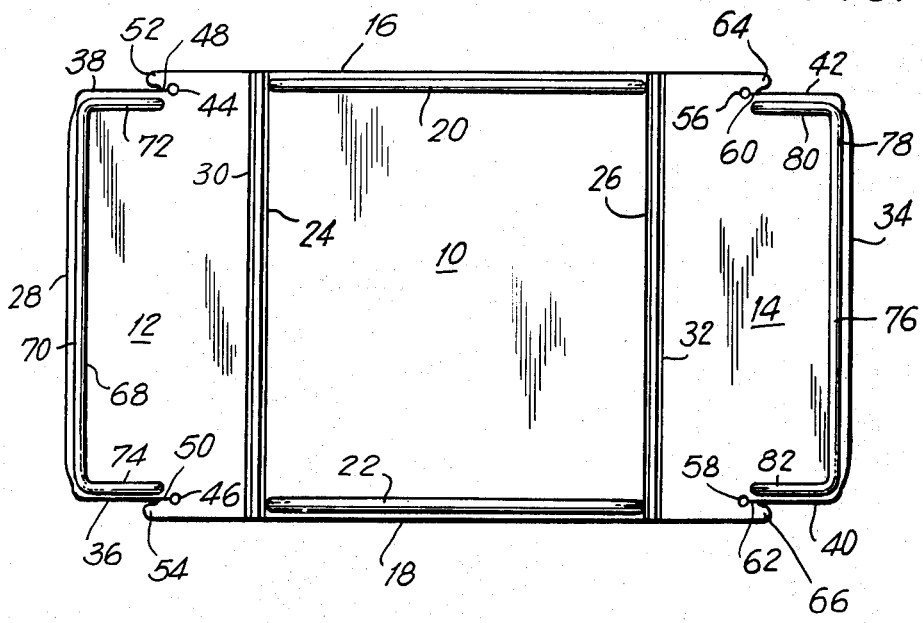
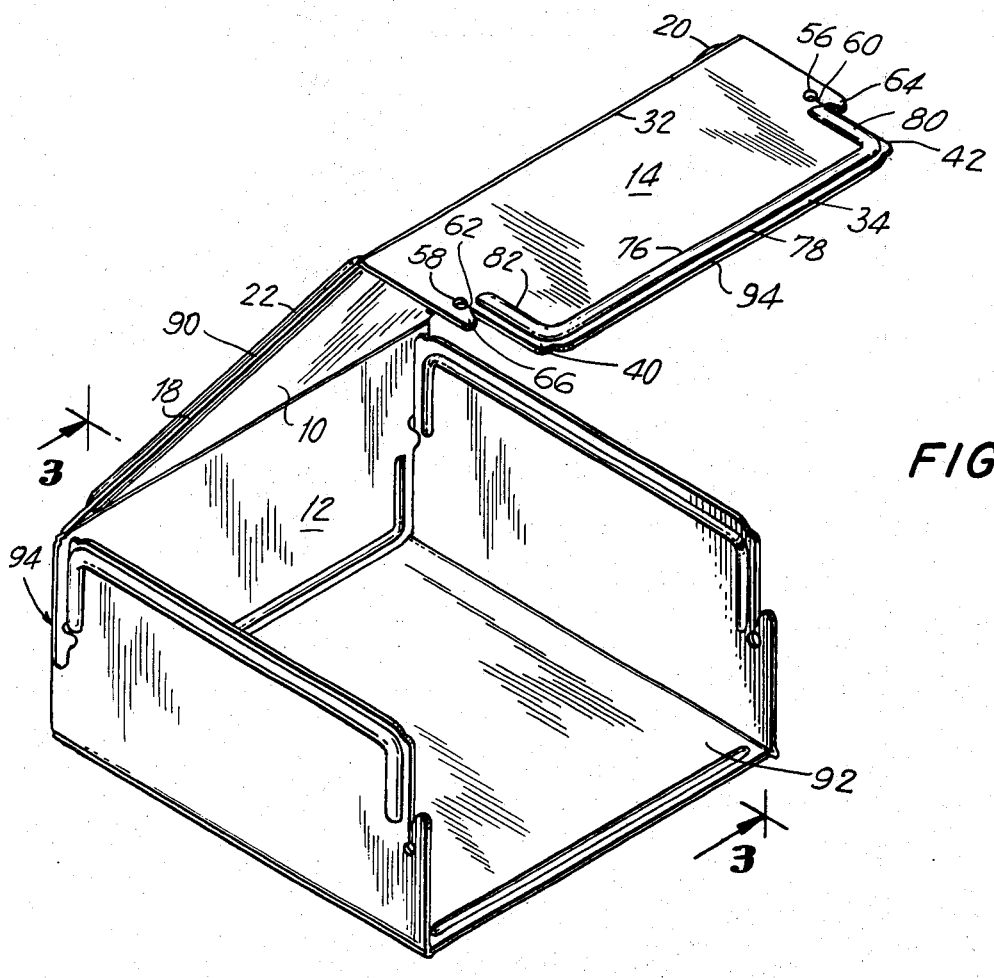
FIG. 2

RELATIVELY FLAT BLANK FOR A CONTAINER AND THE CONTAINER MADE THEREFROM

CROSS-RELATED APPLICATION

This application is a continuation-in-part of my earlier application Ser. No. 526,371 filed Nov. 22, 1974 now U.S. Pat. No. 3,924,798.

FIELD OF INVENTION

This invention relates to collapsible containers and to foldable flat blanks which are adapted for being formed into a container.

SUMMARY OF INVENTION

It is an object of the invention to provide an improved container structure fabricated in generally flat form and constituted of one or more blanks adapted for being folded to provide the final container structure.

It is another object of the invention to provide an improved container structure adapted for being fabricated from blanks which are readily stacked for storage and, when so stacked, will not shift or move relative to one another.

Yet another object of the invention is to provide an improved container blank adapted for being coated for strength and having the ability to receive color printing and the like on one surface thereof whereas the other surface can remain in its original condition.

Still another object of the invention is to provide an improved container structure which is moisture proof and which is especially suitable for use as cake boxes and the like.

A further object of the invention is to provide an improved container design which is readily adaptable to various sizes and which is readily adapted to have insulation qualities.

Still another object of the invention is to provide an improved construction for containers which is especially suitable for the application of graphics.

Yet another object of the invention is to provide a container blank having recesses whereby two blanks can be interengaged in cross-wise relation to form a container.

To achieve the above and other objects of the invention there is provided a collapsible container structure comprising first and second sections. These sections each include hingeably connected generally quadrilateral central and wing sectors with the wing sectors being connected on opposite sides of the central sector so that each central sector has two opposite edge sides and two further sides connected to the associated wing sectors. The sectors of the first section correspond at least substantially in size and shape to the sectors of the second section. The sections are each foldable into a U-shape and are interengageable with each other to form a parallelepiped structure enclosing a chamber. Each wing sector has a side connected to the associated central sector and an opposite parallel side. Each wing sector further has two lateral sides extending between the first two said sides thereof. Means are provided on at least one of the wing sectors of each section for locking the said wing sectors together.

According to one embodiment of the invention, the aforesaid first and second sections are separate parts and each said parallel side is a free side and each said edge side is also a free side.

According to another embodiment of the invention, the first and second sections are integral with one another.

According to a feature of the invention, each central sector is provided with grooves extending along and adjacent the free sides thereof for receiving and accommodating the free sides of the wing sectors of the other section.

According to another feature of the invention, each wing sector is provided with a channel extending along the free and lateral sides thereof and at least in part providing for strengthening the associated wing sector as well as providing for stacking purposes.

According to still a further feature of the invention, the aforesaid means includes hook shaped members on the free side of the wing sectors.

In accordance with the invention, the section may be, for example, of expanded polystyrene foam. As an alternative, the sections may be made of transparent plastic material.

According to a further feature of the invention, each hook shaped member of the wing sector includes a lip at each free side outwardly of the related channel, the lip adapted for insertion into a corresponding lip of a hook shaped member, the central sector of the other section with the related channel of the related wing sector resting on the latter said central sector.

In the aforesaid construction, the grooves may preferably be rectilinear.

In the embodiment of the invention wherein the first and second sections are integral with one another, one parallel side of one wing sector is connected to one edge side of the central sector of the other section. In this construction, each central sector is provided with a groove adjacent at least one edge side. Furthermore, in this embodiment, at least one wing sector for each section is provided with a channel extending along and adjacent the parallel and lateral sides thereof.

In further accordance with the invention, a relatively flat blank for a container is provided which comprises a quadrilateral central sector and two wing sectors hingeably connected on opposite sides of the central sector, said central sectors having two first sides connected to the wing sectors and two parallel sides extending between the first sides and being provided with a groove extending along at least one of said parallel sides, said wing sector including spaced parallel sides, one of which is connected to said central sector, and lateral sides connected between the latter said parallel sides, there being furthermore provided hook means on each wing sector and on the two parallel sides of the central sector.

Other objects, features and advantages of the invention will be found in the detail description which follows hereinafter.

BRIEF DESCRIPTION OF DRAWINGS

In the drawing:

FIG. 1 is a top plan view of a blank provided for a collapsible container in accordance with one embodiment of the invention;

FIG. 2 is a perspective view of a container formed by a fuse of two blanks such as illustrated in FIG. 1;

DETAILED DESCRIPTION

Figure 3:
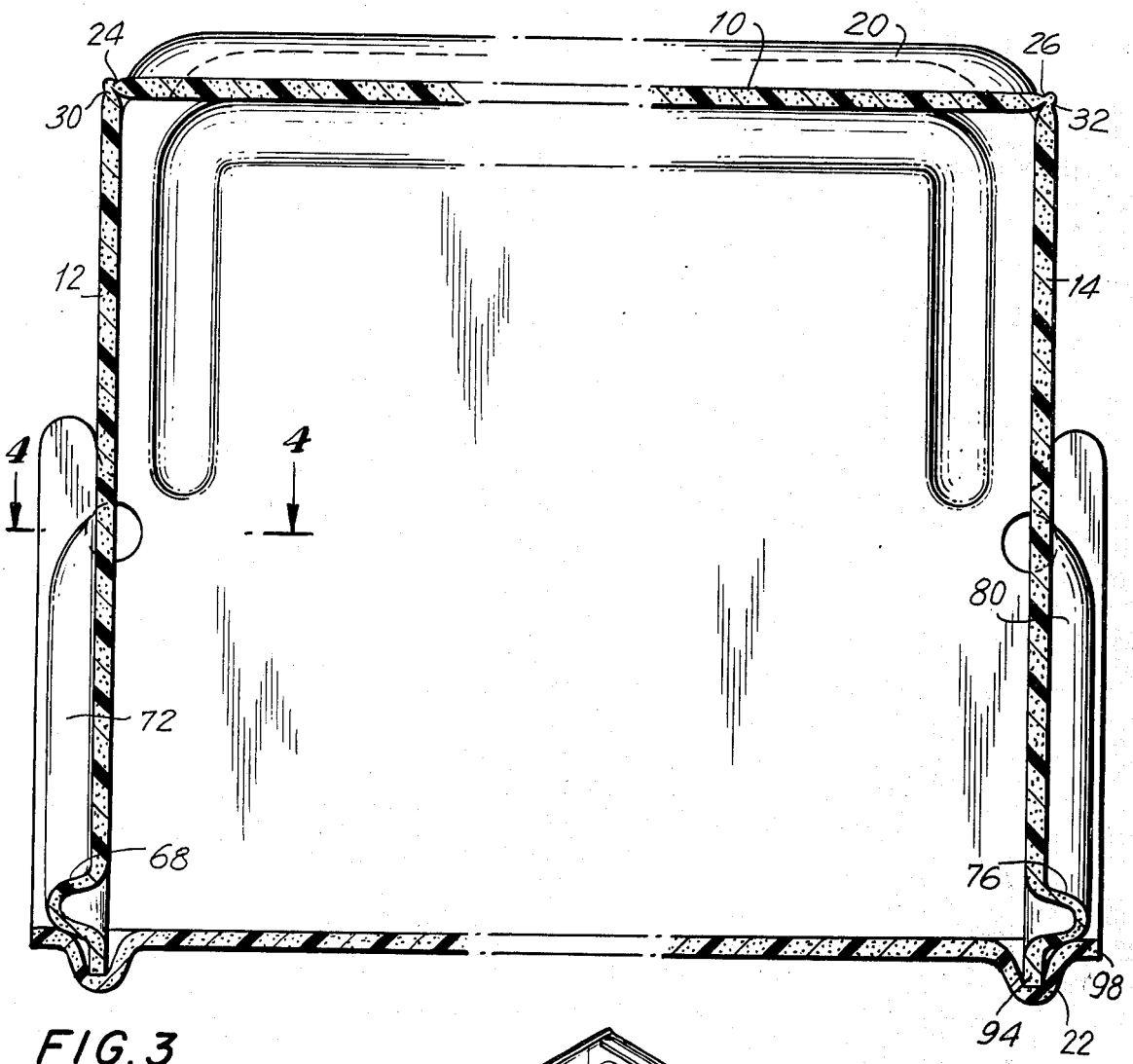
FIG. 3 is a cross-sectional view taken along line 3—3 in FIG. 2 with the container closed.

As has been noted hereinabove, there is provided in accordance with the invention, a blank adapted for being folded to constitute by itself or in combination with another like blank a container. The blank is of generally flat form although channels and grooves as well as score lines may be provided therein which will give the blank a three-dimensional characteristic although the blank will generally be regarded as flat in form.

In FIG. 1 is shown a blank constituting one section of a container for which two such blanks will generally be employed. This blank includes a central sector 10 and two wing sectors 12 and 14.

The central sector is provided with two free or edge sides 16 and 18 adjacent which runs a parallel rectilinear groove 20 or 22. In addition, the central sector is provided with two further sides 24 and 26 at which hinged connection is made with the wing sectors 12 and 14.

The wing sector 12 is provided with parallel sides 28 and 30, one of which is hingedly connected to the side 24 of the central sector 10 whereas side 28 constitutes a free side. Wing sector 14 includes parallel sides 32 and 34 of which side is hingedly connnected to side 26 of central sector 10 whereas side 34 is a free side.

In addition to the above, wing sector 12 is provided with lateral sides 36 and 38 whereas wing sector 14 is provided with lateral sides 40 and 42.

Wing sector 12 is further provided with holes 44 and 46 to which are connected slits or slots 48 and 50. The presence of these holes and slots from hook members 52 and 54 which are substantially separated from the associated wing sector but which are nevertheless connected in cantilever manner to the same.

Wing sector 14 is similarly constituted being provided with holes 56 and 58 to which are connected slits or slots 60 and 62 forming hook sections 64 and 66. The purpose of the hooks or hook-like members will be explained hereinafter.

It will be noted that the central and wing sectors are generally quadrilateral in shape, the central sector being generally in the form of a square with the wing sectors 12 and 14 being generally in the form of modified rectangles.

In addition to the above, it will be noted that the wing sector 12 is provided with a channel 68 which is of U-shape and thereby includes rectilinear sections 70, 72 and 74 whereof sections 72 and 74 run parallel to the lateral sides 36 and 38 whereas central section 70 runs parallel to free side 28. Wing sector 14 is similarly constituted being provided with a U-shaped channel 76 including rectilinear section 78 and lateral sectors 80 and 82.

It can be seen from an examination of FIG. 2 that two sections 90 and 92 are employed to make a container, both of these sections being bent into generally U-shape and being interengaged to form a parallelepiped construction enclosing a chamber. It will further be seen that the hook members are interengaged such as indicated at 94 to lock the sections together, as a consequence whereof, no additional force or retaining arrangement is necessary for purposes of forming a container or relatively strong construction.

In addition to the above, it will be noted that, for example, the groove 22 of section 92 is adapted to receive the lip 94 which is formed in the sector 14 outwardly of the associated channel 76.

Referring next to FIG. 3, it will be seen that the channel 76 and the association lip 94 are so formed in relation to the depth of the groove 22 that the lip 94 will abut in the bottom of channel 22 whereas the channel 74 will abut as indicated at 96 on the lip 98 which is formed outwardly of the groove 22.

Figure 4:
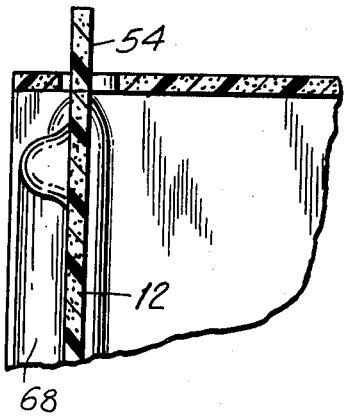
FIG. 4 is a fragmentary enlarged view in cross-section taken along line 4—4 in FIG. 3.

The engagement between, for example, the hook members 54 of two separate sections appears on enlarged scale in FIG. 4, this being a representative cross-section along lines 4—4 in FIG. 3.

Figure 5:
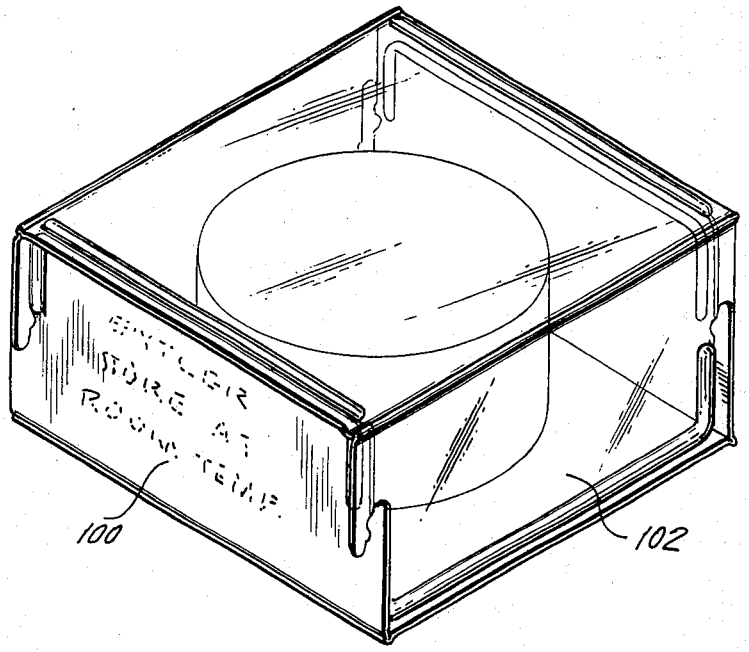
FIG. 5 is a perspective view of a closed container utilizing blanks of the shape illustrated in FIG. 1 with the blanks being made of different materials.

FIG. 5 illustrates the version of the invention illustrated and described above with respect to FIGS. 1–4 but in which the section 100 is made of a generally opaque material such as expanded polystyrene foam. The section 102 in this case is, however, manufactured of any clear and transparent plastic having suitable strength and adapted to cooperate with the section 100 in the manner generally indicated hereinabove.

Figure 6:
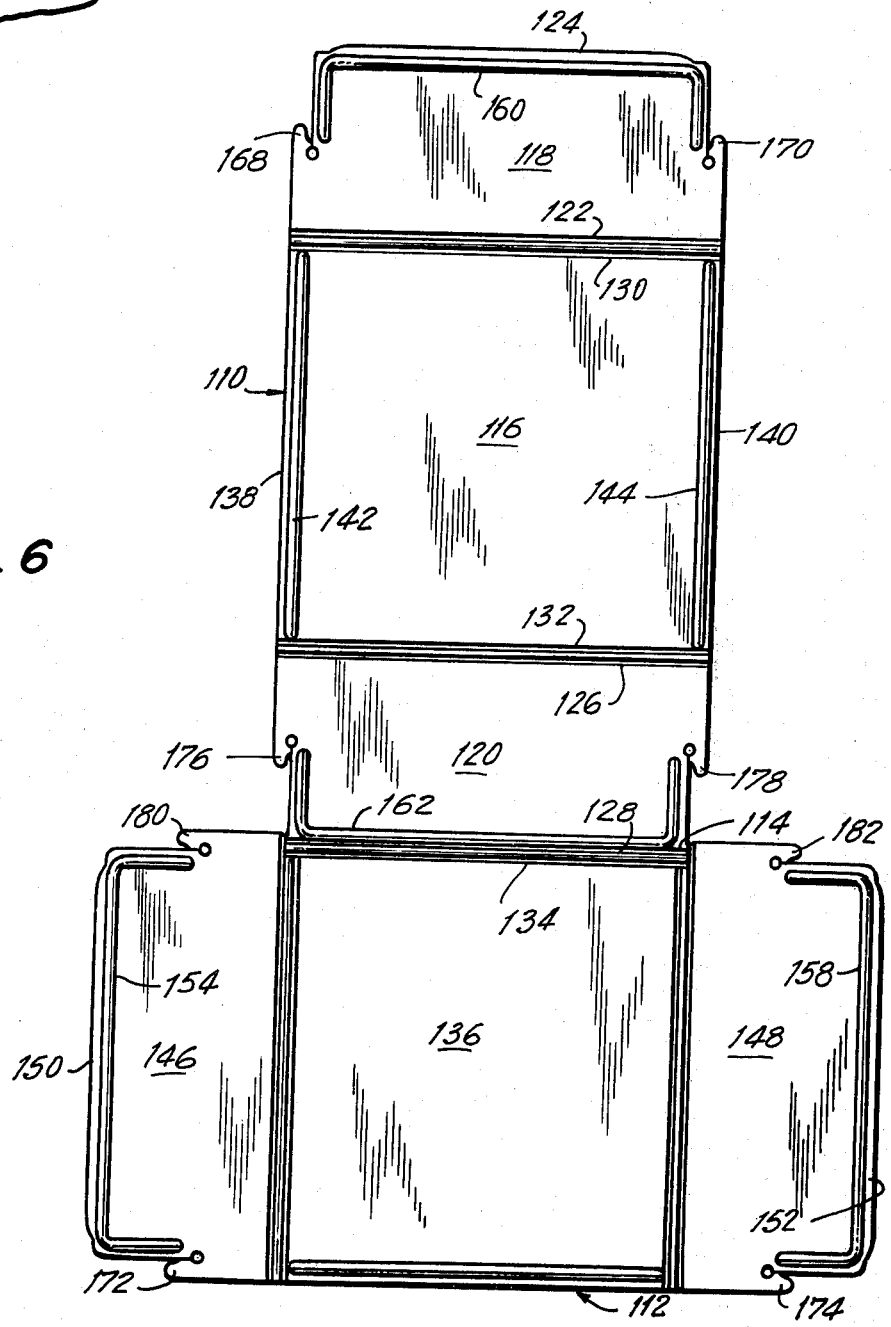
FIG. 6 is a blank provided in accordance with the invention but modified to constitute a second embodiment thereof.

FIG. 6 illustrates a further embodiment of the invention wherein the first and second sections 110 and 112 are connected together as indicated generally at 114.

In this embodiment of the invention, section 110 includes a central sector 116 and wing sectors 118 and 120 connected thereto. For this purpose, wing sector 118 includes parallel sides 122 and 124 whereas wing sector 120 includes parallel sides 126 and 128. Sides 122 and 126 are hingeably connected to first sides 130 and 132 of central sector 116 whereas side 124 of sector 118 is a free side and side 128 is connected to side 134 of central sector 136 of the section 112.

As in the aforegoing embodiment of the invention, central sector 116 is provided with parallel sides 138 and 140 adjacent which are arranged rectilinear parallel grooves 142 and 144.

The section 116 is moreover provided with wing sectors 146 and 148 having free sides 150 and 152 adjacent which are arranged parallel U-shaped channels 154 and 158.

Wing sector 118 of section 110 may be provided with a U-shaped channel such as indicated at 160 and wing sector 120 is provided with a U-shaped channel which may be optional and is indicated at 162.

In the illustrated embodiment of the invention appearing in FIG. 6, section 110 is provided with hook members 168 and 170 adapted for engagement with hook members 172 and 174. The blank may optionally also be provided with hook members 176 and 178 as well as with hook members 180 and 182 which may also be employed for interim engagement.

The embodiment of FIG. 6 may be generally regarded to be similar to that described hereinabove in that two sections are provided, each of which are adapted to be bent into a U-shaped form and interengaged to form a parallelpiped construction for enclosing a chamber in which may be accommodated, for example, a cake or a pie or some other such commodity which is intended to be transported as well as shielded against the ambient atmosphere.

Figure 7:
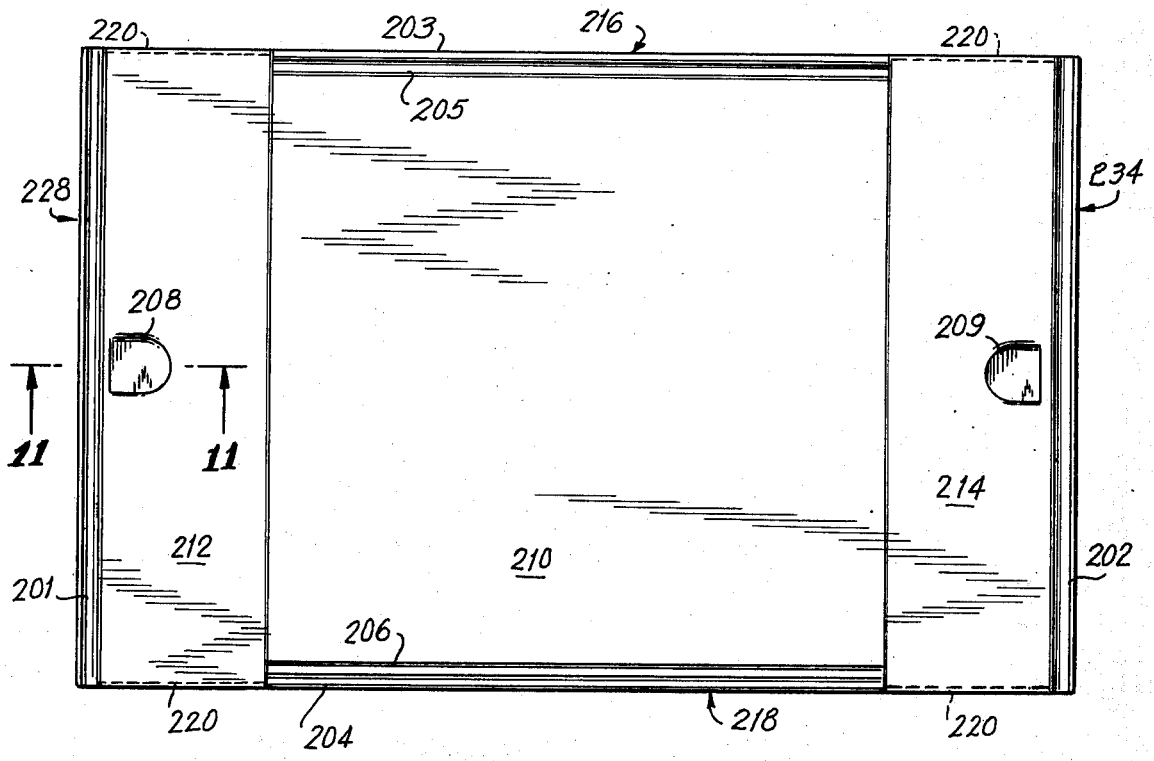
FIG. 7 is a top plan view of a blank in accordance with a third embodiment of the invention.
Figure 8:
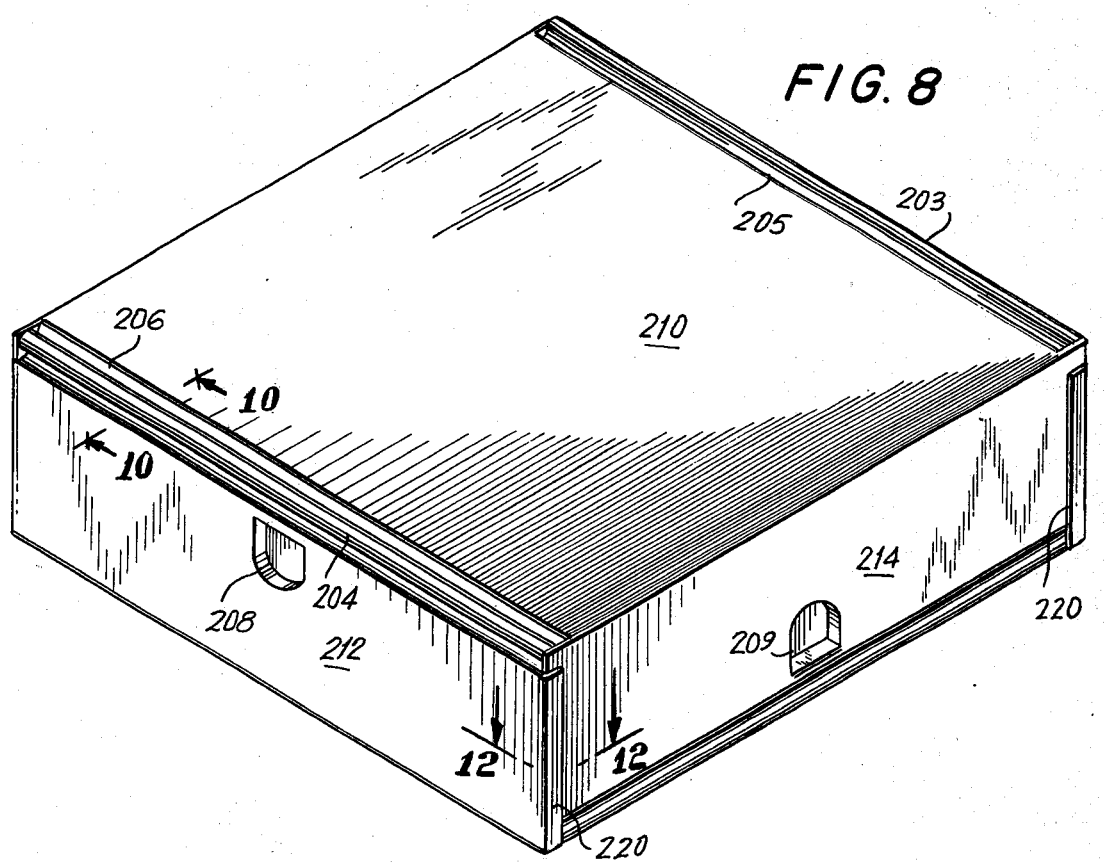
FIG. 8 is a perspective view of a closed container utilizing blanks of the shape illustrated in FIG. 7.
Figure 9:
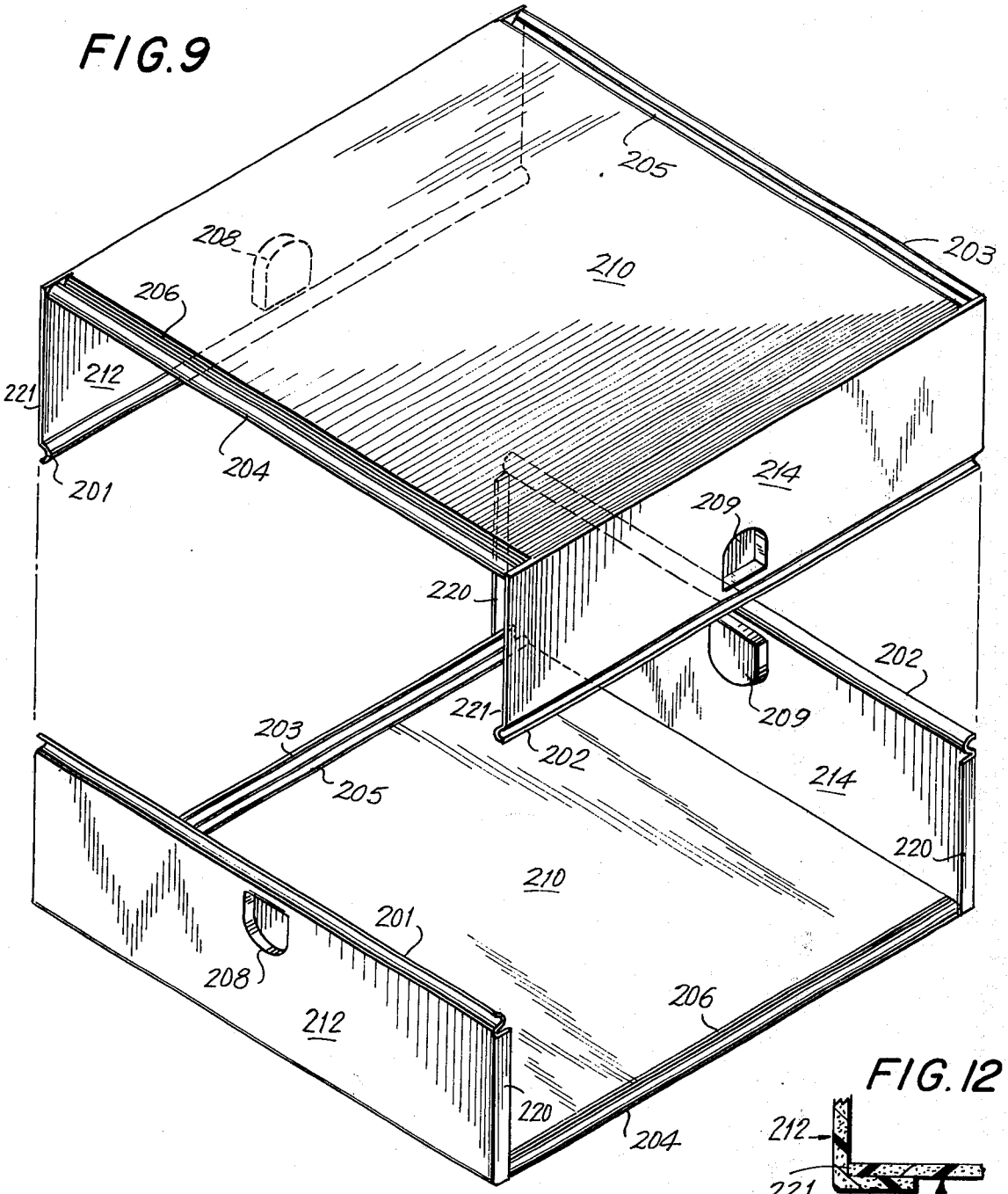
FIG. 9 is an exploded view of the containter in FIG. 8.

FIG. 7 shows a modified embodiment of a blank adapted for being bent into U-shaped and interengaged with a second similar blank also bent into U-shape as evident from FIGS. 8 and 9. The embodiment of FIG. 7 is characterized by the provision of a distinctive hook means for interengagement purposes, such hook means being in the form of rounded bends constituting hook portions 201, 202 respectively extending along the free edges 228, 234 of wing sectors 212 and 214 and hook portions 203, 204 formed along edge sides 216 and 218 of central sector 210. Adjacent the hook portions 203 and 204 on the central sector and respective grooves 205 and 206 which serve a purpose to be explained more fully later. The lateral side edges of the wing sectors of one blank are formed with right angle bends 220 while the lateral side edges 221 of the other blank are plain for a reason which will become apparent later.

Figure 12:
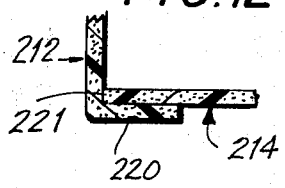
FIG. 12 is a sectional view taken along line 12—12 in FIG. 8.
Figure 10:
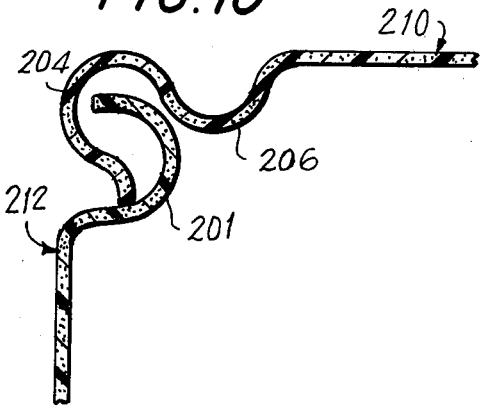
FIG. 10 is a sectional view taken along line 10—10 in FIG. 8.
Figure 11:
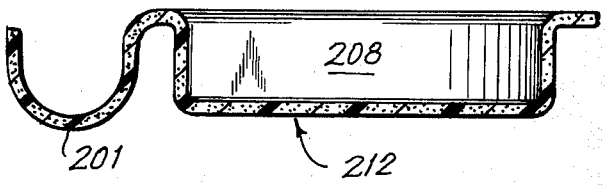
FIG. 11 is a sectional view taken along line 11—11 in FIG. 7.

In order to assemble a container, two blanks are bent into U-shape as shown in FIG. 9 and arranged crosswise at right angles to one another. The hook portions along four peripheral edges of one section, i.e. hook portions 201–204 are interengaged with corresponding hook portions of the other section to form the container shown in FIG. 8. The bends 220 on the lateral side edges of the wing sectors of one blank overlay the plain edges 221 of the other blank shown in FIG. 12 to form closures at the corners of the container. The interengagement of the hook portions 201–204 is effected relatively simply due to the flexibility of the wing sectors resulting from their pivotal connection with the center sector. The hook portions 203 and 204 on the edge sides of the central sector, with which the hook portions 201 and 202 interengage, are more rigid since they are directly formed on the edge sides of the central sector. The interengagement of a typical pair of hook portions is evident from FIG. 10. As can be seen from this Figure, the purpose of the grooves 205 and 206 disposed on the central sector adjacent respective hook portions 203 and 204 is to abut against the respective hook portions on the respective wing sectors of the other blank to prevent inward displacement of such wing sectors. Thus as seen in FIG. 10, hook portion 201 on wing sector 212 of one blank engages hook portion 204 at side edge 218 of the central sector 210 of the other blank, and groove 206 abuts hook portion 201 and prevents inward displacement thereof.

It is to be noted that the hook portions on the wing sectors face away from one another while the hook portions on the central sector face towards one another. In this way, the hook portions oppose one another as shown in FIG. 10 and the lips of such hook portions interengage one another. A similar arrangement would result by reversal of the direction of the hook portions on the wing sectors and central sector.

The wing sectors are provided with deep recesses 208, 209 adjacent respective hook portions 201, 202 and when the container is assembled as shown in FIG. 8 these recesses serve as suitable finger-engaging portions to facilitate the opening of one of the wing sectors to provide access to the interior of the container.

A container composed of sections made of a polyurethane or polystyrene foam is especially adapted for holding products whose temperature is considerably different from ambient temperature due to the insulative properties of the foam material. Another feature applicable to this material is its shape memory and its tendency to return to its original configuration following distortion thereof due to heat or pressure. Thus, for example, if the container is used for storing heated bakery products or pizza, unless moisture is released from the container, it will make the product soggy. The container of the invention permits this by a bowing of the central sectors under the pressure created in the container by the heat and moisture from the product causing a slight release of the hook portions on the center sector from the hook portions on the wing sectors allowing escape of the moisture and reduction of the pressure. After the pressure is reduced due to exist of the steam at the edges, the memory of the material automatically produces reengagement of the hook portions and returns the container to its tightly closed configuration for retaining the heat of the product.

Although the embodiment of FIGS. 8-12 contemplates the use of two blanks which are slightly different as regards the pressure of the bends 220 on one blank and the plain edges 221 on the other blank, this does not pose any difficulties regarding manufacture since the blanks are identically formed in a die and during a die-cutting operation, the bends 220 are cut-off from every other blank.

However, it is also possible to employ identical blanks by forming the bends 220 only on the lateral sides of one wing sector while leaving the lateral sides of the other wing sector plain.

Under certain circumstances, it is even feasible to omit the bends 220 entirely such as where closure of the corners of the container are not important as, for example, where the product is not a heated one.

From what has been indicated hereinabove, it will now be appreciated that the invention relates to a container adapted for being formed from one or more collapsible blanks constituted by first and second sections, each including hingeably connected generally quadrilateral central and wing sectors with the wing sectors being connected on opposite sides of the central sector so that each central sector has two opposite edge sides and two further sides connected to the associated wing sectors, the sectors of the first section corresponding at least substantially in size and shape to the sectors of the second section, the sections each being foldable into a U-shape being interengageable with each other to form a parallelepiped structure enclosing a chamber, each wing sector having a side connected to the associated central sector and an opposite parallel side, each wing sector further having two lateral sides extending between the first two said sides thereof, there being furthermore provided hook means on at least one of the wing sectors and the central sector of each section for locking the sectors together.

There will now be obvious to those skilled in the art many modifications and variations of the structure set forth hereinabove. These modifications and variations will not depart from the scope of the invention if defined by the following claims.

What is claimed is:

1. A collapsible container comprising first and second sections each including hingeably connected, generally quadrilateral central and wing sectors with the wing sectors being connected on opposite sides of the central sector so that each central sector has two opposite free edge sides and two further sides connected to the associated wing sectors, the sectors of the first section corresponding at least substantially in size and shape to the sectors of the second section, the sections each being foldable into a U-shape and being interengageable in cross-wise relation with each other to form a parallelpiped structure enclosing a chamber, each wing sector having a side connected to the associated central sector and a free opposite parallel side with a free end, each wing sector further having two free lateral sides extending between the first two said sides thereof, and hook-shaped portions on said free ends of the wing sectors and on the free edge sides of the central sectors, the hook-shaped portions on the wing sectors being engaged with the hook-shaped portions of the central sectors to lock the sectors together, each central sector being provided with grooves extending along and adjacent the hook portions thereof for preventing inward movement of the free ends of the wing sectors of the other section.

2. A container as claimed in claim 1 wherein the first and second sections are separate parts.

3. A container as claimed in claim 1 wherein said hook-shaped members on the free sides of said wing sectors extend substantially along the entire length thereof.

4. A container as claimed in claim 1 wherein at least one of said sections is of a foam material.

5. A container as claimed in claim 1 wherein at least one of said sections is of a transparent plastic material.

6. A container as claimed in claim 1 wherein said grooves are rectilinear and parallel to the hook-shaped portions at said free side edges of the central sectors.

7. A container as claimed in claim 1 wherein at least one said wing sector is provided with a finger-engaging recess extending between said hook-shaped portion and the side connected to the central sector.

8. A relatively flat blank for a container comprising a quadrilateral central sector and two wing sectors hingeably connected on opposite sides of the central sector, said central sector having two first sides connected to the wing sectors and two parallel sides each of extending between the first sides, said wing sectors including spaced parallel sides one of which is connected to said central sector, the second of which is a free side, and lateral sides connected between the latter said parallel sides, hook means on the free side of at least one wing sector and on at least one parallel side of said central sector, a groove being provided in said central sector adjacent said hook means.

9. A blank as claimed in claim 8 wherein said hook means extends along the free sides of both wing sectors and along both parallel sides of the central sector, said hook means comprising hook-shaped bend portions at said sides of the wing sectors and central sectors.

10. A blank as claimed in claim 9 wherein the hook-shaped bend portions on the wing sectors and the central sector are bent to face in opposite directions.

11. A blank as claimed in claim 10 wherein said hook-shaped bend portions are coextensive in length with the associated sides of the respective sectors.

12. A blank as claimed in claim 10 wherein each wing sector is provided with a finger-engaging recess extending from the associated hook-shaped bend portion towards the side connected to the central sector.

13. A blank as claimed in claim 8 comprising a second central sector and two further wing sectors hingeably connected to said central sector, said second central sector being connected to one of the parallel sides of the wing sectors.

* * * * *